United States Patent [19]

Lawson

[11] 4,438,674

[45] Mar. 27, 1984

[54] MUSICAL EXPRESSION PEDAL

[76] Inventor: Richard J. A. Lawson, 8 Mary St., Auburn, New South Wales 2144, Australia

[21] Appl. No.: 329,877

[22] Filed: Dec. 11, 1981

[30] Foreign Application Priority Data

Apr. 11, 1980 [AU] Australia ..... PE3086

[51] Int. Cl.[3] ..... G10H 1/02

[52] U.S. Cl. ..... 84/1.24; 84/DIG. 25

[58] Field of Search ..... 340/562, 563, 365 C; 84/1.27, 1.24, DIG. 7, DIG. 25; 200/DIG. 1; 307/116, 117; 361/280

[56] References Cited

U.S. PATENT DOCUMENTS

| | | | |
|---|---|---|---|
| 2,873,637 | 2/1959 | Herold | 84/DIG. 7 |
| 3,775,546 | 11/1973 | Honegger | 84/1.01 |
| 3,838,318 | 9/1974 | Schmidt et al. | 361/280 |
| 4,006,441 | 2/1977 | Goodrich | 84/1.27 |
| 4,046,049 | 9/1977 | Luce et al. | 84/1.27 |
| 4,121,488 | 10/1978 | Akiyama | 84/DIG. 25 |
| 4,176,575 | 12/1979 | Munch | 84/1.01 |
| 4,213,367 | 7/1980 | Moog | 84/1.27 X |
| 4,275,383 | 6/1981 | White et al. | 340/365 C |
| 4,276,538 | 6/1981 | Eventoff et al. | 84/DIG. 7 |
| 4,323,829 | 4/1982 | Witney et al. | 307/116 |

*Primary Examiner*—F. W. Isen

*Attorney, Agent, or Firm*—Cushman, Darby & Cushman

[57] ABSTRACT

An expression pedal assembly for a musical instrument with conventional electromechanical control means of the pedal being replaced by proximity control means. The pedal assembly is comprised of a casing which houses a proximity detector plate, a proximity detector circuit and may include an audio circuit compartment. Earth shielding of the bottom and walls of the casing is provided. A heel rest at one end of the pedal casing serves to provide the only support for a musician's foot and is so positioned to support the sole of the foot above the proximity device to provide the musician with swift and fluent control of a musical function controlled by the response of the proximity device to movement of said sole.

5 Claims, 3 Drawing Figures

MUSICAL EXPRESSION PEDAL

This is a continuation-in-part application of patent application, Ser. No. 330,314, filed on Dec. 11, 1981, now abandoned, This invention relates to electrical musical instruments, and more particularly to a foot-controlled expression pedal therefor.

BACKGROUND AND SUMMARY OF THE INVENTION

In many electrical, or electronic, musical instruments of today both hands of the musician are usually fully occupied in the creation of musical notes and in some instances the musician's foot is employed for obtaining, or control of, expression in the music. This is especially so in the case of the so-called keyboard instruments, and especially electronic organs, synthesizers and the like. The aim, for example, of an electronic organ is to closely simulate the sounds and timbre of many solo instruments which have totally different wave complexities, such as variable vibrato in the case of a violin and selective attack in the case of a piano. A form of synthesizer known as the "THEREMIN" has been proposed which utilizes a proximity detector device responsive to the capacitive effect of the player's hand in its region to create an audible tone changeable in pitch with hand movement to and from the detector. It is possible, by fluttering of the hand in space, to create a variable vibrato effect at the will of the player. Hence both the tone and its animation is determined solely by the spacing, and movement, of the hand from the proximity detector. This instrument is limited in the complexity of musical compositions capable of being rendered.

It would obviously be a great advantage if an electronic organ could be equipped with the same manual control of animation of created sound, but as both hands are usually fully occupied in the selection of the tones of the musical piece, it is not feasible to incorporate the hand operated facility of the "THEREMIN". Furthermore, the desired effect cannot be created by merely utilizing a proximity detector device in lieu of the present-day electro-mechanical arrangement of the organ's expression pedal. The inertia and balance of the pedal plate and its linkage is such that sufficiently swift and fluent control is not possible with the foot satisfactorily to obtain the above effects and many others such as selective attack and accent on notes.

A prime object of the invention is to provide an expression pedal for a musical instrument which is capable of improved control by the foot of the player than are contemporary pedals.

In accordance with one general form of the invention there is provided a foot-controlled expression pedal for a musical instrument comprising a supporting frame, an electrical proximity responsive device fixed with respect to said frame, and foot support means on said frame engageable beneath the heel of said foot for the latter's only support and permitting pivoting of said foot about said support means for freely raising and lowering the sole of said foot above said proximity responsive device to change the response thereof.

The invention will now be described in more detail with reference to the accompanying drawings in which:

DETAILED DESCRIPTION OF THE INVENTION

Figure 1:
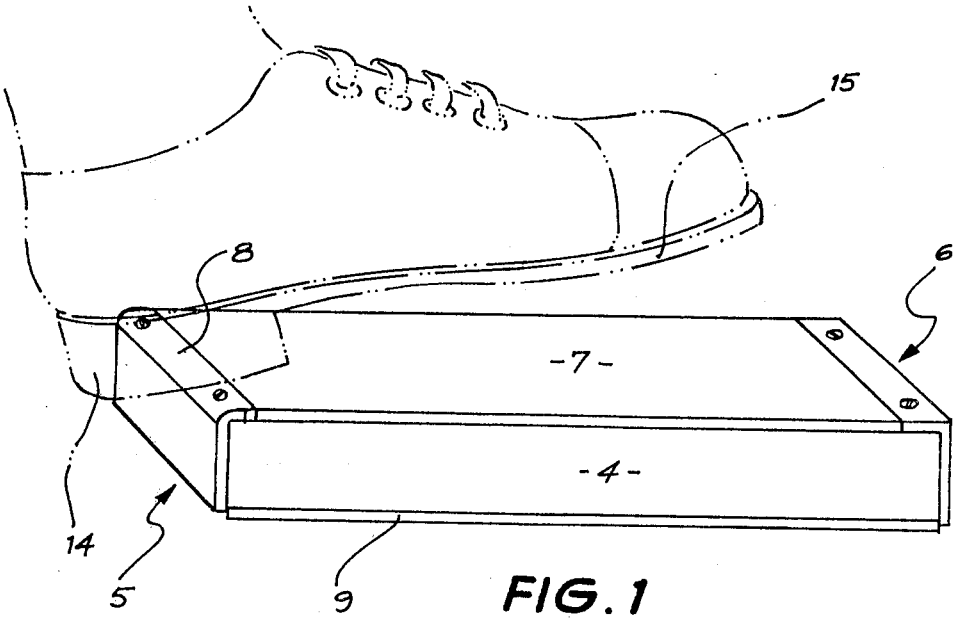
FIG. 1 shows in perspective a first embodiment of an expression pedal constructed according to this invention.
Figure 2:
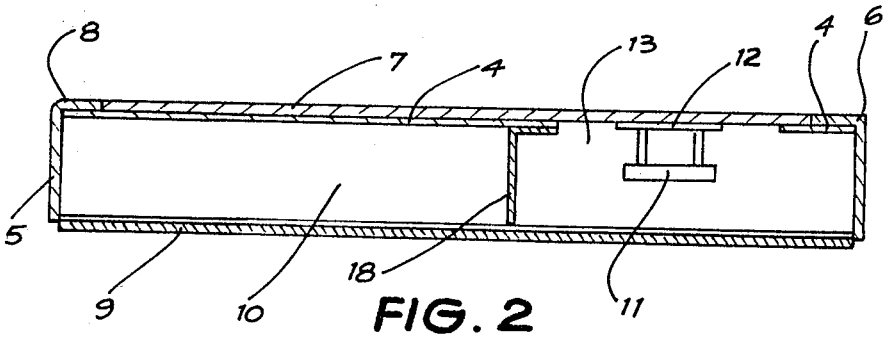
FIG. 2 is a side elevation in longitudinal section of the pedal shown in FIG. 1.

The first preferred embodiment of the invention as shown in FIGS. 1 and 2 consists of a rectangular box formed from aluminium box suite extrusion 4 to provide a top, a bottom and opposite sides, and L-section extruded aluminium end pieces 5 and 6 are secured to the end portions of the extrusion 4 to enclose its open ends. An aperture 13 is made in the top of the box near the forward end. A relatively thin sheet of rigid electrically insulating material is applied to the top of the box and covers the aperture 13 and extends between the end pieces 5 and 6. The outside corner of the end piece 5 may be bevelled and serves as a heel rest pivot 8 to be explained hereafter. A rubber floor mat 9 may be attached to the underside of the bottom for frictional grip upon a floor.

A transversely extending partition formed from L-section extruded aluminium divides the interior of the box into two compartments. A first compartment 10 serves to house electrical circuitry associated with the pedal. A proximity detector device 11 is fixedly spaced from its detector plate 12 which in turn is secured to the underside of the insulating sheet 7 in the aperture 13 of the second compartment of the box extrusion 4.

The proximity detector device 11 may be of the capacity type detecting the capacitance to earth of an object within proximity range. Other forms of proximity detectors, however, may be utilized such as an inductive device (not shown). Such a device may control the illumination of an incandescent light bulb which in turn controls a light dependent device to which an audio circuit is responsive. This form of controlling means does have some inertia. An inductive proximity detector may, therefore, include a metal plate joined to a layer of organic insulative material beneath it, with a second metal plate positioned remotely above the first and having an organic insulative layer joined to the top of the second plate. The light bulb is connected to the two metal plates and the lower metal plate is connected to the secondary coil of an induction apparatus. In such an instance the top plate is the proximity sensor.

It is not essential to provide separate compartments within the foot pedal box, but it will be found convenient for wiring of electrical acoustic circuitry in the compartment 10 to the proximity detector device 11. Where only a single compartment is provided and the acoustic circuitry located remotely from the pedal box, an earthed transmission cable may connect the latter to the device 11.

It will be appreciated that an expression pedal constructed in this form is intended for portability and, therefore, the proximity detector device 11 will be subjected to different influences depending upon surrounding objects and their materials. This change of influence can be compensated for by retuning of the circuitry associated with the proximity detector 11. However, by this invention the compartment containing the device 11, whether it is the entire box or a portion thereof, is provided with an earth shield at least at its bottom and around its side walls.

An important aspect of the expresson pedal casing described above is that the heel rest pivot 8 for the foot of the operator is a transversely extending surface, or line, to support the operator's heel 14 at or near its transverse centre line. It has been found that pivoting of the foot in this area enables the sole 15 to be moved swiftly and fluently by the operator. Not only is control by the operator of movement of the sole of his foot hindered by the contemporary practice of pivoting a mechanical expression plate near the centre of the foot, but these electromechanical pedal plates have considerable inertia. With the use of an expression pedal of the present construction, the control available to the operator of the movement of the sole of his foot with respect to the detector plate 12 is such as to facilitate the creation of hitherto unobtainable musical effects, such as faster and more fluent expression, variable attack and accent on individual notes, and selective vibrato and tremolo animation in a musical piece. By the inclusion of a stop or tab upon the musical instrument the selective response of the detector device 11 may be switched from control of frequency for vibrato effects to amplitude for tremolo effects. As an alternative, the heel rest pivot 8 may be provided in the form of an upwardly projecting abutment against which the rear of the heel 14 may be rested for pivoting of the foot at this point. However, the control of movement of the sole 15 is not in this instance as pronounced as when pivoting occurs near the transverse centre line of the heel 14.

Figure 3:
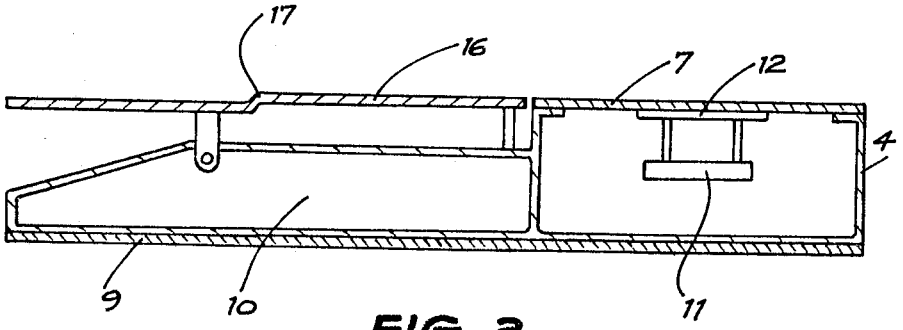
FIG. 3 is a similar view to FIG. 2 of a second embodiment of the invention.

The embodiment shown in FIG. 3 incorporates an electro-mechanical expression pedal combined with a proximity responsive expression pedal of the kind described above. In this case the mechanical pedal plate 16 has a conventional pivot lying beneath a central part of the operators foot and a heel abutment 17 is provided upon the plate 16 to allow the operator's foot to slide forward so that the sole of the foot overlies the proximity detector 11 and its detector plate 12. In this instance the box 4 housing the proximity device 11 is provided in open-topped form and is covered by the insulating sheet 7. The purpose of providing this thin sheet 7 of electrically insulating material, as in the instance of the embodiment of FIGS. 1 and 2, is to avoid contact clicks in the amplifier of the musical instrument when the player's foot is lowered onto the detector plate 12. A similar compartment 10 is provided for housing accoustic circuitry and a rubber floor mat 9 is also attached to the bottom of the unit. It will be observed that with an expression pedal formed in this way, a choice of either mechanical or proximity responsive expression control is available to the musician. When the mechanical pedal plate 16 is moved to its fully forward position, a foot resting upon it may be slid forward to the abutment 17 so that the sole of the foot lies above the proximity detector 11. The detector 11 is earth shielded so as to be responsive only to the presence of overlying objects and is unaffected by a foot movable with the mechanical expression plate 16.

In a further embodiment (not shown) a plurality of expression pedals such as described with FIGS. 1 and 2, above, may be juxtaposed for operation as selected by the musician. Each pedal, incorporating a proximity device 11, may be connected with the electrical circuitry for control of a different musical effect. In one application of this embodiment a single master oscillator may be used with each proximity detector device 11 controlling the operating frequency of a filter, with the amplitude of a high frequency signal at the output of each filter being detected to generate each control signal for controlling separate audio effect circuits.

The musical expression pedal of this invention may be utilized in many different applications. For example, it may be applied to automatic bypass switching which can be triggered by a control signal derived from the proximity device 11 so that at the remotest proximity effect distance the bypass switch is switched on, while being normally off during response of the detector 11 to the presence of an operator's foot. Hence such switching may be utilized for bypassing the audio effect circuit controlled by the expression pedal. Furthermore, automatic bypassing may be switched in every alternate time the musician's foot is withdrawn from the pedal while alternately the audio effect circuit remains connected. A lamp indication may be used to record the state of the bypass switch. Also, automatic bypassing may be combined with sequencing of a number of audio effect circuits with indication of different effects by appropriate lamps. Therefore, when the musician's foot is withdrawn from the pedal, the automatic bypass may switch on and the next effect in a sequence is selected and will remain in circuit when the foot is placed back upon the pedal and can then be controlled according to the movement of the musician's foot. Upon the next removal of the foot from the pedal, the succeeding effect is selected.

As further applications of this invention a combination pedal may be used to control flanging by the electro-mechanical pedal while double tracking or pure double tracking or pure differential double tracking is achieved by use of the proximity responsive device 11. For example, the expression pedal of the invention may contain a pure differential double tracking circuit with the duration control being controlled by the proximity detector 11. Automatic alternate bypassing may be incorporated so that while the musician's foot is removed from the pedal every alternate time, the difference between the time of arrival of the two audio tracks remains fixed at around say 1/15 of a second. In such a state the pedal produces a 1/15 second double tracking effect without the musician's foot being placed upon the pedal. As the musician's foot is again placed on the pedal and the sole of the foot approaches the proximity detector 11, the time delay between the two tracks become less. As the sole of the foot attains the limit of responsive range closest to the detector plate 12 it may cause the time delay to diminish to around twenty milliseconds. An indicator lamp may be provided which is extinguished while the switching is in the audio bypassing state.

Whereas several embodiments have been described in the foregoing passages it should be understood that other forms, modifications, and refinements are feasible within the scope of this invention.

What I claim is:

1. An expression pedal for a musical instrument wherein the pedal or the instrument including the pedal is transportable and thus the pedal is susceptible to detuning by influence from different surroundings, said pedal comprising a casing having enclosing side walls, forward and rear walls, a bottom and a top all of which comprise capacitive shielding material, an electrically insulating panel over said top of the casing, an electrical proximity responsive device mounted within the casing and towards said forward wall thereof and exposed to said panel by a hole in said top, and a bevelled edge on an upper corner of said rear end wall, whereby a user's foot when pivoted at the heel upon said bevelled edge with the sole of the foot rising and falling over said proximity device causes varying electrical response in said proximity device.

2. An expression pedal according to claim 1, wherein said proximity responsive device is mounted directly to the underside of said exposed panel.

3. An expression pedal according to claim 1, wherein said proximity responsive device has a detector plate secured to the underside of said panel and a proximity detector supported depending from said detector plate.

4. An expression pedal according to claim 2, wherein said proximity responsive device has a detector plate secured to the underside of said panel and a proximity detector supported depending from said detector plate.

5. An expression pedal according to claim 1, wherein said casing has an internal partition dividing its interior into two compartments, said proximity responsive device being located in a forward one of said compartments.

* * * * *